US008767023B2

(12) United States Patent
Sakai et al.

(10) Patent No.: US 8,767,023 B2
(45) Date of Patent: Jul. 1, 2014

(54) SCANNING IMAGE DISPLAY DEVICE AND METHOD OF CONTROLLING THE SAME

(75) Inventors: Yuji Sakai, Nagoya (JP); Tomomi Katano, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 332 days.

(21) Appl. No.: 13/356,982

(22) Filed: Jan. 24, 2012

(65) Prior Publication Data

US 2012/0188266 A1 Jul. 26, 2012

(30) Foreign Application Priority Data

Jan. 24, 2011 (JP) ..... 2011-012170

(51) Int. Cl.
*G09G 5/10* (2006.01)

(52) U.S. Cl.
USPC ..... 345/690; 345/589; 345/691; 345/207

(58) Field of Classification Search
USPC ..... 345/690, 691, 589, 76, 611; 396/128; 348/223.1
See application file for complete search history.

(56) References Cited

U.S. PATENT DOCUMENTS 8,638,342 B2 * 1/2014 Cote et al. ..... 345/611
2004/0036708 A1 * 2/2004 Evanicky et al. ..... 345/691
2009/0067828 A1 * 3/2009 Ono et al. ..... 396/128
2009/0244407 A1 10/2009 Sakakibara
2010/0103083 A1 * 4/2010 Shin et al. ..... 345/76
2011/0187892 A1 * 8/2011 Takeuchi ..... 348/223.1
2011/0216056 A1 * 9/2011 Yoo et al. ..... 345/212
2012/0081385 A1 * 4/2012 Cote et al. ..... 345/589

FOREIGN PATENT DOCUMENTS

JP 7-147446 6/1995
JP 2009-244797 10/2009

* cited by examiner

*Primary Examiner* — Thuy Pardo
(74) *Attorney, Agent, or Firm* — Scully, Scott, Murphy & Presser, PC

(57) ABSTRACT

A scanning image display includes a light source, a light detector, a scanning section, a storage section, a current controlling section, a reference current section, a sweep section, and a change section. The light detector detects the laser light emitted from the light source. The scanning section scans the laser light. The current controlling section controls laser light by supplying a current supplied to the light source. The storage section is configured to store a reference current value, a reference light output value, and a gamma table. The reference current section supplies the reference current value to the current controlling section. The sweep section sweeps current values supplied to the current controlling section to obtain one current value where the detected laser light corresponds to the reference light output value. The change section changes the gamma table based on the one current value obtained by the sweep section.

14 Claims, 12 Drawing Sheets

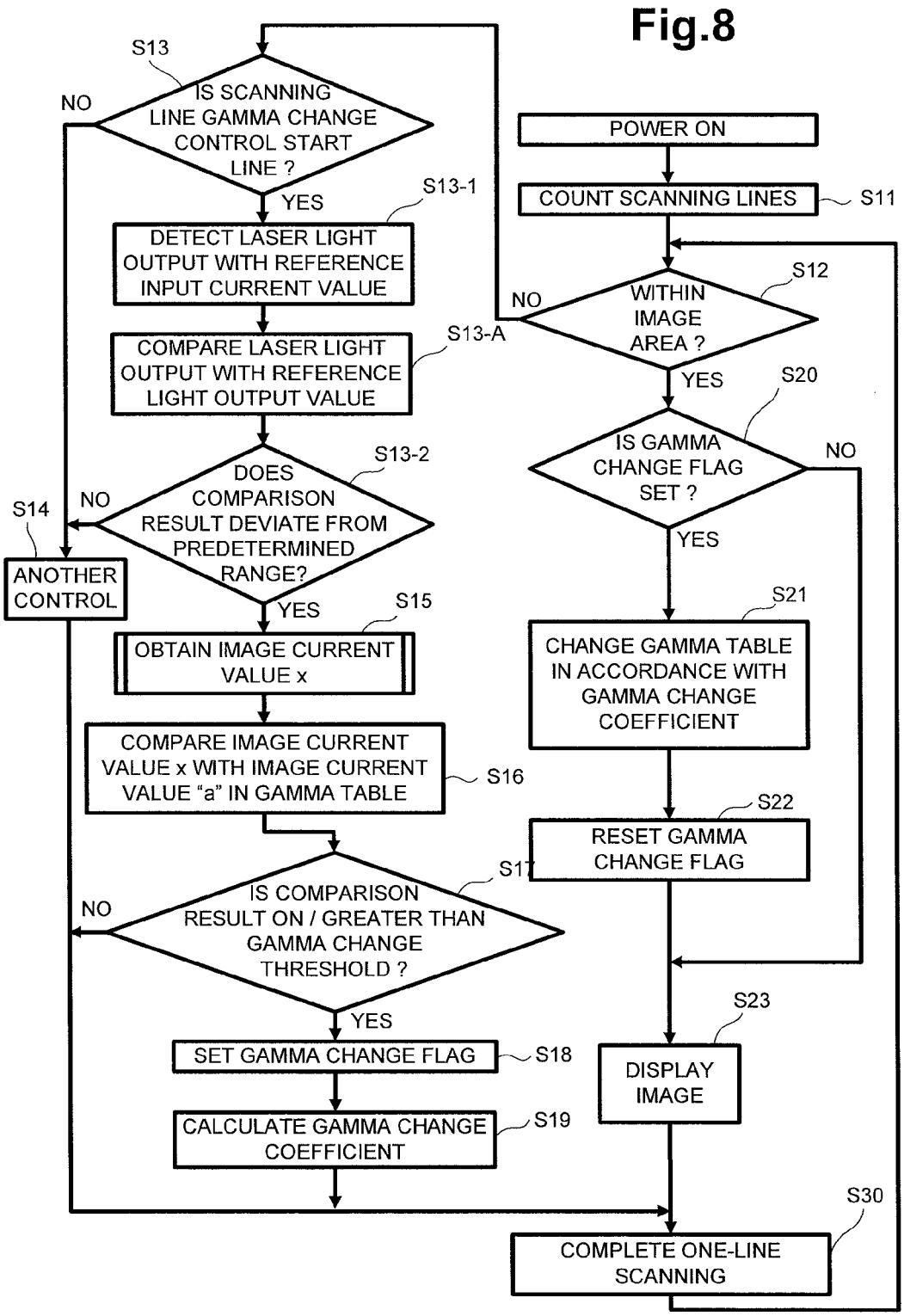
Fig.8
POWER ON
COUNT SCANNING LINES
S11
WITHIN IMAGE AREA ?
S12
NO
YES
IS GAMMA CHANGE FLAG SET ?
S20
NO
YES
CHANGE GAMMA TABLE IN ACCORDANCE WITH GAMMA CHANGE COEFFICIENT
S21
RESET GAMMA CHANGE FLAG
S22
DISPLAY IMAGE
S23
COMPLETE ONE-LINE SCANNING
S30
IS SCANNING LINE GAMMA CHANGE CONTROL START LINE ?
S13
NO
YES
DETECT LASER LIGHT OUTPUT WITH REFERENCE INPUT CURRENT VALUE
S13-1
COMPARE LASER LIGHT OUTPUT WITH REFERENCE LIGHT OUTPUT VALUE
S13-A
DOES COMPARISON RESULT DEVIATE FROM PREDETERMINED RANGE?
S13-2
NO
YES
ANOTHER CONTROL
S14
OBTAIN IMAGE CURRENT VALUE x
S15
COMPARE IMAGE CURRENT VALUE x WITH IMAGE CURRENT VALUE "a" IN GAMMA TABLE
S16
IS COMPARISON RESULT ON / GREATER THAN GAMMA CHANGE THRESHOLD ?
S17
NO
YES
SET GAMMA CHANGE FLAG
S18
CALCULATE GAMMA CHANGE COEFFICIENT
S19

Fig.9A

INITIAL GAMMA TABLE

53A

| INPUT BRIGHTNESS VALUE | IMAGE CURRENT VALUE |
|---|---|
| 0 | · |
| 1 | · |
| 2 | · |
| 3 | · |
| · | · |
| A | a |
| · | · |
| X | x |
| B | b |
| · | · |
| M | m |

Fig.9B

CHANGED GAMMA TABLE

53B

| INPUT BRIGHTNESS VALUE | IMAGE CURRENT VALUE |
|---|---|
| 0 | · |
| 1 | · |
| 2 | · |
| 3 | · |
| · | · |
| A | x |
| A+1 | x+α |
| A+2 | x+2α |
| A+3 | x+3α |
| · | · |
| X | x+(n-1)α |
| B | x+nα |
| · | · |
| M | m |

SCANNING IMAGE DISPLAY DEVICE AND METHOD OF CONTROLLING THE SAME

CROSS-REFERENCE TO RELATED APPLICATION

This Application claims priority from JP2011-012170, filed on Jan. 24, 2011, the content of which is hereby incorporated by reference.

BACKGROUND OF THE DISCLOSURE

1. Field of the Disclosure

The present disclosure relates to a scanning image display device which scans laser light emitted from a light source section which includes a semiconductor laser and projects the scanned laser light on a projection target.

2. Description of the Related Art

A scanning image display device which includes a light source section, a scanning section and a projecting section has been proposed. The light source section emits laser light of intensity corresponding to an image signal. The scanning section two-dimensionally scans the laser light emitted from the light source section. The projecting section projects laser light scanned by the scanning section on a projection target and displays an image. Examples of the scanning image display device include a retinal scanning image display device of which projection target is a retina of a viewer's eye and an optical scanning display device of which projection target is a screen.

In such a scanning image display device, a semiconductor laser (i.e., a laser diode) may be used as a light source which constitutes the light source section. The semiconductor laser emits substantially no light until a value of supplied current reaches a specific threshold current value. Thus, a bias current is supplied to the light source in order to let the light source be in a standby state from the viewpoint of improving response of the light source section. That is, in a system in which an image is displayed with the laser light emitted from the light source section, a driving current corresponding to the image signal is superimposed on the bias current and is supplied to the light source.

The characteristics of the above-described semiconductor laser described above, i.e., the light source (i.e., a relationship between the current of the light source and the light output) change with, for example, heat generated during emission of the laser light, changes in the ambient temperature, and age deterioration. Then, an Automatic Power Control (APC) in which the optical output is controlled automatically is proposed as a technique to keep the optical output of the light source section constant. With the APC, for example, a bias current supplied to the light source is controlled such that the optical output of the light source becomes a predetermined value in accordance with the optical output of the light source detected by, for example, a photo diode.

SUMMARY OF THE DISCLOSURE

For example, in a case in which the APC is performed such that a black level at which image output is 0% as a reference of color does no change, a modulation width in a current-light output characteristics changes as illustrated in FIG. 12. That is, if the temperature changes (Tc1 to Tc2) as illustrated in FIG. 12, the characteristics of a light source changes and then a threshold current value changes. This causes a problem that a relationship between input image data (i.e., an input brightness value) in accordance with an input current value and a gamma table is destroyed, which disturbs a color balance. Thus, if the threshold current value of the light source changes, a relationship between the gamma table used to correct an output current value of the image (i.e., gamma correction) and the input image data is destroyed, which may cause defects of, for example, unstable brightness of the displayed image.

An object of the present disclosure is to provide a scanning image display which is capable of obtaining appropriate brightness of the displayed image with stable image quality by changing the gamma table in accordance with the change in the threshold current value of the light source.

An aspect of the present disclosure is a scanning image display device. The scanning image display includes a light source section, a light detecting section, a scanning section, a light source control section, a reference current section, a sweep section, and a change section. The light source section is configured to emit laser light. The light detecting section is configured to detect the laser light. The scanning section is configured to scan the laser light within a scanning area. The current controlling section is configured to control laser light by supplying a current supplied to the light source. The storage section is configured to store a reference current value, a reference light output value, and a gamma table. The reference light output value corresponds to the reference current value. The gamma table relates input brightness values of an image to image current values and is used to adjust the current supplied to the current controlling section, where the current supplied to the current controlling section is selected from the image current values. The reference current section is configured to supply the reference current value to the current controlling section. The sweep section is configured to sweep current values supplied to the current controlling section to obtain one current value where the detected laser light corresponds to the reference light output value when a light output detected by the light detecting section deviates from the reference light output value by a predetermined value or greater. The change section is configured to change the gamma table based on the one current value obtained by the sweep section.

Another aspect of the present disclosure is a method of controlling light output in a scanning image display device. The method includes detecting a laser light emitted from a light source, scanning the laser light, supplying a reference current value to the light source, sweeping current values supplied to the light source, and changing a gamma table based on one current value obtained by the sweeping. The sweeping is performed when a light output of the laser light detected deviates from the reference light output value by a predetermined value or greater. One current value where the detected laser light corresponds to a reference light output value is obtained by the sweeping. The reference light output value corresponds to the reference current value. The gamma table relates input brightness values of an image to image current values and is used to adjust the current supplied to the light source.

Another aspect of the present disclosure is a scanning image display device. The scanning display device includes a light source, a light detector, a scanner, a driving signal supply circuit, a first memory, a second memory, and a processor. The light source is configured to emit laser light. The light detector is configured to detect the laser light. The scanner is configured to scans the laser light. The driving signal supply circuit is configured to supply drive current to the light source. The first memory is configured to store a reference current value, a reference light output value, and a gamma table. The reference light output value corresponds to the reference current value. The gamma table relates input brightness values of an image to image current values and is used to adjust the current supplied to the driving signal supply circuit where the current supplied to the driving signal supply circuit is selected from the image current values. The second memory is configured to store computer readable programs. The processor is configured to execute the computer readable programs to provide a reference unit, a sweep unit, and a change unit. The reference unit is configured to supply the reference current value to the driving signal supply circuit as the drive current. The sweep unit is configured to sweep current values supplied to the driving signal supply circuit to obtain one current value where the detected laser light corresponds to the reference light output value when a light output detected by the light detector deviates from the reference light output value by a predetermined value or greater. The change unit is configured to change the gamma table based on the one current value obtained by the sweep unit.

BRIEF DESCRIPTION OF THE DRAWINGS

For a more complete understanding of the invention, the needs satisfied thereby, and the objects, features, and advantages thereof, reference now is made to the following description taken in connection with the accompanying drawings.

FIG. 8 illustrates a flow of the procedure when the gamma table is changed.

FIG. 9A illustrates an initial gamma table.

FIG. 9B illustrates a changed gamma table.

DESCRIPTION OF THE PREFERRED EMBODIMENTS

Hereinafter, an embodiment of the present disclosure will be described with reference to FIGS. 1 to 8 surface. In the following description, a retinal scanning image display device (RSD) in which scanned laser light is projected on a viewer's at least one of retinas to be recognized is described as a scanning image display. However, the scanning image display may be other device, such as a projector which forms an image of the projected image on a screen or the like.

Structure of the RSD

First, electrical and optical configurations of an RSD 1 according to the present embodiment will be described with reference to FIGS. 1 and 2. In the RSD 1 according to the present embodiment, a projection target is a retina 10*b* of at least one of the eyes 10 of a viewer. That is, the RSD 1 displays an image by projecting, by a projecting section, laser light scanned by the scanning section which scans the laser light as a light beam and lets the projected light enter a pupil 10*a*. In particular, the RSD 1 lets weak light be scanned at high speed and be projected on the viewer's retina 10*b* and thereby lets the viewer recognize a residual image of the scanned on the retina 10*b*.

Figure 1:
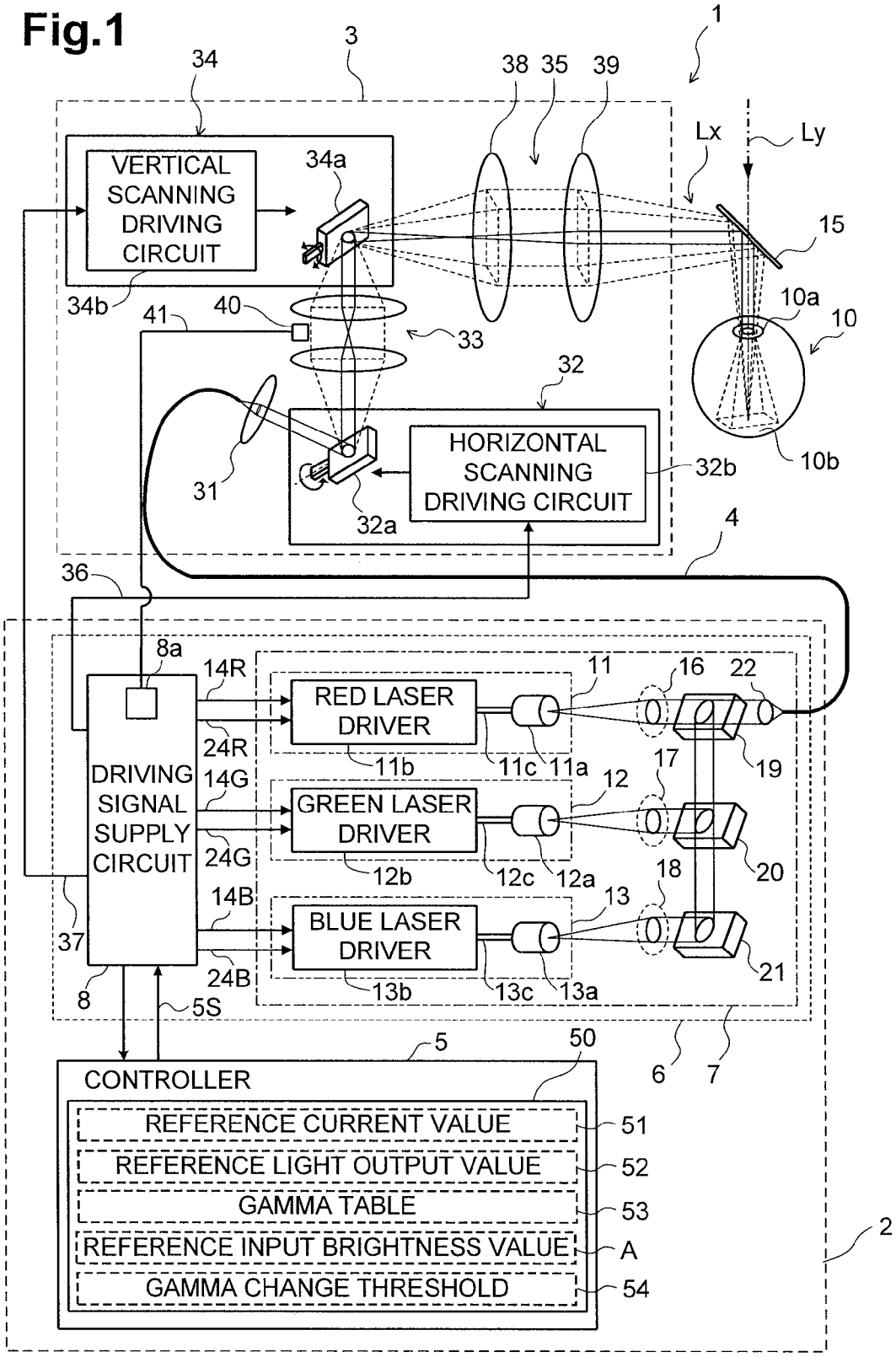
FIG. 1 illustrates an entire configuration of the scanning image display.

As illustrated in FIG. 1, the RSD 1 includes a control unit 2 and a projection unit 3. The control unit 2 emits laser light of intensity in accordance with an image signal as imagewise light. The imagewise light emitted from the control unit 2 is transmitted to the projection unit 3 via an optical fiber cable 4.

The control unit 2 generates an image signal in accordance with, for example, content data stored in a storage section 50 included in the controller 5. The storage section 50 is a memory composed of an electrically erasable programmable read-only memory (e.g., flash memory). The control unit 2 emits, to the optical fiber cable 4, laser light of intensity in accordance with the generated image signal as the imagewise light. Data stored in, for example, an external storage device (not illustrated) provided separately from the control unit 2 may be read into a storage device of the controller 5 via a storage medium as the content data.

The projection unit 3 scans the imagewise light transmitted via the optical fiber cable 4 to let the imagewise light be recognizable by the viewer as a display image. The projection unit 3 two-dimensionally scans the imagewise light of which intensity has been modulated for each color of red (R), green (G) and blue (B) in the control unit 2 and causes the scanned imagewise light to be incident on a viewer's eye 10.

The control unit 2 includes a controller 5 and a light source unit 6. The light source unit 6 includes a light source section 7 and a driving signal supply control circuit 8.

The controller 5 controls components of the RSD 1 comprehensively by performing predetermined processes in accordance with a control program which is stored in advance. The controller 5 includes various functional components, such as a microcomputer, the storage section 50, a RAM (Random Access Memory), a VRAM (Video RAM), and a plurality of I/O interfaces, which are connected via a bus for data communication. But the controller 5 may include electric circuits (e.g., application specific integrated circuits (ASIC) or Field Programmable Gate Array (FPGA)) that perform the various functional components instead of the microcomputer. These functional components control the RSD 1 by transmitting and receiving various types of information via the bus. The storage section 50, which is an example of a first memory, stores at least a reference current value 51, a reference light output value 52, a gamma table 53, a reference input brightness value A, and a gamma change threshold 54. The storage section 50 is also an example of a second memory. That is, the storage section 50 stores computer readable programs executed by the controller 5. However, a ROM (Read Only Memory) for the programs may be provided separately from the storage section 50.

The reference current value 51 is a value set in a increased side of a threshold current value of semiconductor lasers 11*a*, 12*a* and 13*a* (described below) of each color included in the light source section 7. The reference light output value 52 is a light output value corresponding to the reference current value 51. The gamma table 53 is a table used for the correction of an image current value. The gamma table 53 includes initial gamma table 53A (FIG. 9A). When the initial gamma table 53A changes, the gamma table 53 also includes a changed gamma table 53B separated from the initial gamma table 53A. The input brightness value corresponds to a brightness value of the pixel of the input image data. Here, the reference input brightness value A corresponds to the reference current value 51 in the initial gamma table 53 (see FIG. 9A). The gamma change threshold 54 is a threshold which is used when it is determined whether changing the gamma table 53 is required (see S17 of FIG. 8). The reference current value 51, the reference light output value 52, the gamma table 53, the reference input brightness value A, and the gamma change threshold 54 are stored in the storage section 50 at the factory. Both the reference light output value 52 and the gamma change threshold 54 have a tolerance. That is, the reference light output value 52 and the gamma change threshold 54 are defined by a certain value with a range centering on the certain value.

The controller 5 receives input of the image data. The image data may be input from an external device (not illustrated) connected via an I/O terminal or the like. The image data may be input in accordance with content data stored in advance in the storage section 50 in the controller 5. The controller 5 generates an image signal 5S with reference to the input image data. The image signal 5S generated by the controller 5 is sent to the driving signal supply control circuit 8.

Figure 2:
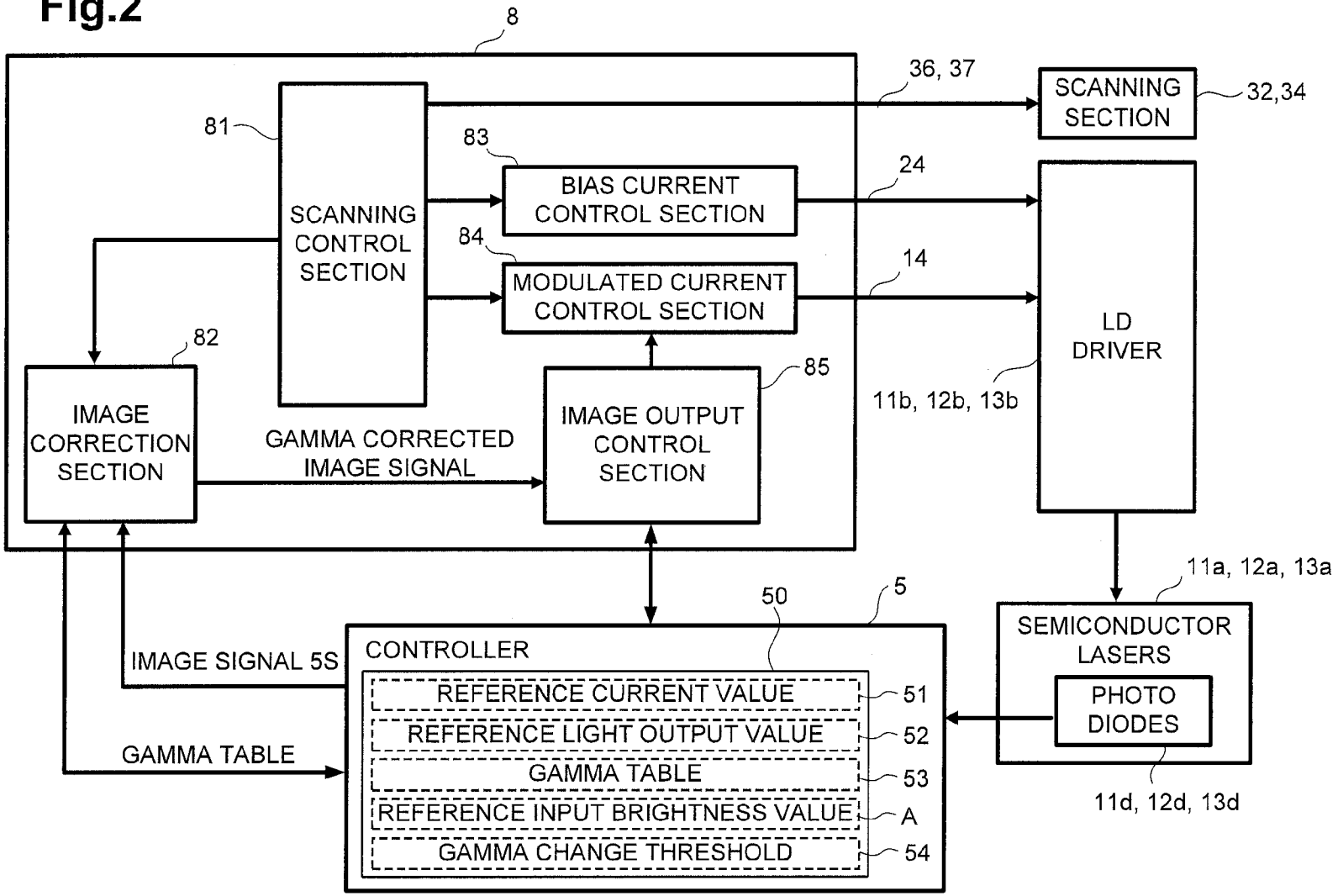
FIG. 2 is a block diagram illustrating a configuration of a control system of the scanning image display.

As illustrated in FIG. 2, the driving signal supply control circuit 8 includes a scanning control section 81, a image correction section 82, a bias current control section 83, and a modulated current control section 84 and an image output control section 85. The image correction section 82 performs gamma correction with reference to the gamma table 53 to thereby lets a displayed image be recognized by a viewer with significantly natural colors. The gamma correction is performed in accordance with timing signal from the scanning control section 81. The gamma corrected image signal is sent to the image output control section 85. The image output control section 85 performs the APC control on the basis of signals, received via the controller 5, from photo diodes (PDs) 11*d*, 12*d*, and 13*d*. The image output control section 85 sends APC controlled image signal to the modulated current control section 84. The driving signal supply control circuit 8 generates a drive signal in accordance with the image signal 5S from the controller 5. That is, the driving signal supply control circuit 8 generates signals as components which form a displayed image on the pixel basis in accordance with the image signal 5S from the controller 5 and then transmits the generated signals to the laser drivers of each color 11*b*, 12*b* and 13*b* (FIG. 2) described below.

The light source section 7 emits laser light of intensity in accordance with the driving signal generated by the driving signal supply circuit 8. The light source section 7 includes a red laser section 11 which generates and emits red laser light, a green laser section 12 which generates and emits green laser light and a blue laser section 13 which generates and emits blue laser light.

The laser sections of each color 11, 12 and 13 include the semiconductor lasers 11*a*, 12*a* and 13*a* as the laser sources which generate the laser light of each color, and the laser drivers 11*b*, 12*b* and 13*b* as the light source driving sections for driving the semiconductor lasers 11*a*, 12*a* and 13*a*. The semiconductor lasers 11*a*, 12*a* and 13*a* of each color includes PDs 11*d*, 12*d*, and 13*d* within their package (see FIG. 2). The lasers 11*a*, 12*a* and 13*a* of each color of R, G and B, and the laser drivers 11*b*, 12*b* and 13*b* of corresponding color are connected via driving lines 11*c*, 12*c* and 13*c*, respectively.

The laser drivers of each color 11*b*, 12*b* and 13*b* each supplies a driving current to the corresponding laser 11*a*, 12*a* and 13*a* in accordance with the drive signal input from the modulated current control section 84 in the driving signal supply circuit 8. Then the lasers 11*a*, 12*a* and 13*a* each emits laser light of intensity modulated in accordance with the driving current supplied from the corresponding laser drivers 11*b*, 12*b* and 13*b*. Therefore, the red laser section 11 lets the laser driver 11*b* drive the laser 11*a* in accordance with a driving signal 14R supplied from the image output control section 85, and emits red laser light. The green laser section 12 lets the laser driver 12*b* drive the laser 12*a* in accordance with a driving signal 14G supplied from the image output control section 85, and emits green laser light. The blue laser section 13 lets the laser driver 13*b* drive the laser 13*a* in accordance with a driving signal 14B supplied from the image output control section 85, and emits blue laser light.

In the present embodiment, a driving current supplied to each of the semiconductor lasers 11*a*, 12*a* and 13*a* from the laser drivers 11*b*, 12*b* and 13*b* in accordance with a drive signal from the driving signal supply control circuit 8 corresponds to the modulated current which changes in accordance with the image signal 5S. The modulated current control section 84 (FIG. 2) of the driving signal supply control circuit 8 controls the modulated current. The laser drivers of each color 11*b*, 12*b* and 13*b* drive the semiconductor lasers of each color 11*a*, 12*a* and 13*a* by sequentially supplying, on the pixel basis, the semiconductor lasers of each color 11*a*, 12*a* and 13*a* with the modulated current of the size in accordance with the image signal 5S. Intensity of the laser light emitted from the semiconductor lasers of each color 11*a*, 12*a* and 13*a* is modulated through modulation of the modulated current supplied to the semiconductor lasers of each color 11*a*, 12*a* and 13*a*.

The drive signal supply control circuit 8 generates bias current supply signals 24R, 24G and 24B for supplying the bias current to the semiconductor lasers of each color 11*a*, 12*a* and 13*a*. Control to generate the bias current supply signals 24R, 24G and 24B is performed by the bias current control section 83 (FIG. 2). The laser drivers of each color 11*b*, 12*b* and 13*b* supply the bias current to the corresponding semiconductor lasers 11*a*, 12*a* and 13*a* in accordance with the bias current supply signal input from the drive signal supply control circuit 8. Since the bias current causes the semiconductor lasers of each color 11*a*, 12*a* and 13*a* which constitute the light source section 7 to be in a standby state, the response of the light source section 7 becomes quicker. The bias current supply signals 24R, 24G and 24B corresponding to each color may be superimposed on the driving signals 14R, 14G and 14B of corresponding colors and may be output from the drive signal supply control circuit 8.

In the RSD 1 of the present embodiment, the drive signal supply control circuit 8 which constitutes the power supply section functions also as a current supply section which supplies the light source section 7 with the modulated current as a current for displaying an image in accordance with the image signal 5S and with the bias current for letting the light source section 7 be in a standby state. That is, the drive signal supply control circuit 8 generates the driving signals 14R, 14G and 14B and the bias current supply signals 24R, 24G and 24B to be transmitted to the laser drivers of each color 11*b*, 12*b* and 13*b* in order to let the laser drivers of each color

11*b*, 12*b* and 13*b* supply the semiconductor lasers of each color 11*a*, 12*a* and 13*a* with the modulated current and the bias current.

The light source section 7 multiplexes the laser light emitted by the laser sections of each color 11, 12 and 13. The multiplexed laser light is output to the optical fiber cable 4. The light source section 7 includes collimating optical systems 16, 17 and 18, dichroic mirrors 19, 20 and 21 and a coupling optical system 22.

The laser light of each color emitted from the laser sections of each color 11, 12 and 13 is collimated by the collimating optical systems 16, 17 and 18, respectively. The collimated laser light of each color enter the corresponding the dichroic mirrors 19, 20 and 21. Each of the laser light of red, green and blue which enters the corresponding dichroic mirrors 19, 20 or 21 are selectively reflected or transmitted regarding the wavelength and then reaches the coupling optical system 22. The laser light of three colors is multiplexed and condensed by the coupling optical system 22. The condensed laser light enters the optical fiber cable 4. The configuration of the optical system which lets the laser light from the laser sections of each color 11, 12 and 13 be emitted as the light emitted from the light source section 7 is not particularly limited in the present embodiment; any configurations capable of selectively reflecting or transmitting the laser light of each color emitted from the laser sections of each color 11, 12 and 13 regarding the wavelength may be employed.

The projection unit 3 is located between the light source section 7 and the viewer's eyes 10 in the RSD 1. The projection unit 3 includes a collimating optical system 31, a horizontal scanning section 32, a first relay optical system 33, a vertical scanning section 34 and a second relay optical system 35.

The collimating optical system 31 collimates the laser light emitted from the optical fiber cable 4. The horizontal scanning section 32 reciprocally scans the collimated laser light in a horizontal direction to form an image to be displayed. The horizontal direction is an example of a main-scanning direction in the present embodiment. The first relay optical system 33 includes scanning lenses 33*a* and 33*b* and a beam detection (BD) sensor 40. The first relay optical system is provided between the horizontal scanning section 32 and the vertical scanning section 34. The first relay optical system 33 relays the laser light between the horizontal scanning section 32 and the vertical scanning section 34.

The vertical scanning section 34 scans, in a vertical direction, the laser light which has been scanned in the horizontal direction by the horizontal scanning section 32. The vertical direction, which is perpendicular to the horizontal direction, is an example of a sub-scanning direction in the present embodiment. The second relay optical system 35 lets the laser light which has been scanned in the horizontal direction by the horizontal scanning section 32 and in the vertical direction by the vertical scanning section 34 be emitted outside the projection unit 3.

The horizontal scanning section 32 and the vertical scanning section 34 are light scanning devices and the first relay optical system 33 is an optical system which scan the laser light emitted from the optical fiber cable 4 in the horizontal and vertical directions to form a scanned light beam in order to let the laser light be projectable as an image on the viewer's retina 10*b*. Thus, in the present embodiment, the configuration including the horizontal scanning section 32 and the vertical scanning section 34 functions as a scanning section which two-dimensionally scans the laser light emitted from the light source section 7. In the following description, the structure including the horizontal scanning section 32 and the vertical scanning section 34 will be collectively called as the "scanning section".

The horizontal scanning section 32 functions, in the scanning section, as a high-speed scanner which scans the laser light at high speed with respect to the vertical scanning section 34. The horizontal scanning section 32 includes a resonant deflection element 32*a* and a horizontal scanning driving circuit 32*b*. The deflection element 32*a* includes a deflection surface (i.e., a reflective surface) on which the laser light is scanned in the horizontal direction. The horizontal scanning driving circuit 32*b* generates a driving signal which lets the deflection element 32*a* resonate and lets the deflection surface of the deflection element 32*a* fluctuate. The horizontal scanning driving circuit 32*b* generates the driving signal for the deflection element 32*a* in accordance with a horizontal driving signal 36 input from the driving signal supply circuit 8.

The vertical scanning section 34 functions, in the scanning section, as a low-speed scanner which scans the laser light at low speed with respect to the horizontal scanning section 32. The vertical scanning section 34 includes a nonresonant deflection element 34*a* and a vertical scanning driving circuit 34*b*. The deflection element 34*a* includes a deflection surface (i.e., a reflective surface) on which the laser light is scanned in the vertical direction. The vertical scanning driving circuit 34*b* generates a driving signal which lets the deflection surface of the deflection element 34*a* fluctuate in a nonresonant state. The vertical scanning driving circuit 34*b* generates the driving signal for the deflection element 34*a* with reference to a vertical driving signal 37 input from the driving signal supply circuit 8.

The vertical scanning section 34 scans each frame of the image to be displayed with image forming laser light in the vertical direction from the first horizontal scanning line toward the last horizontal scanning line. In this manner, a two-dimensionally scanned image is formed. The term "horizontal scanning line" herein means one scanning event in the horizontal direction by the horizontal scanning section 32. Since the deflection element 32*a* fluctuates, scanning in the horizontal direction includes scanning in both scanning directions: one direction (i.e., an outgoing direction) and another direction (i.e., a return direction). Here, the horizontal scanning line may mean both one-direction scanning and both-direction scanning: in the one-direction scanning, either of the outgoing direction or the return direction is used for image formation; and in the both-direction scanning, both the outgoing direction and the return direction are used for image formation. The deflection elements 32*a* and 34*a* included in the scanning section are, for example, galvanomirrors. The deflection elements 32*a* and 34*a* are driven by, for example, the following drive systems; the piezoelectric drive system, the electromagnetism drive system and the electrostatic drive system.

The first relay optical system 33 includes two scanning lens 33*a* and 33*b*. Both scanning lens 33*a* and 33*b* have positive refractivity. The first relay optical system 33 converges, on the deflection surface of the deflection element 34*a*, the laser light which has been scanned in the horizontal direction by the deflection surface of the deflection element 32*a*. The laser light converged on the deflection surface of the deflection element 34*a* is then scanned in the vertical direction by the deflection surface of the deflection element 34*a*, whereby imagewise light Lx is produced. In the RSD 1, positions of the horizontal scanning section 32 and the vertical scanning section 34 may be inverted; in that case, the laser light is scanned in the vertical direction by the vertical scanning section 34 and then scanned in the horizontal direction by the horizontal scanning section 32. A two-dimensional deflection element which performs both the horizontal scanning and the vertical scanning may be used instead of the deflection element 32*a* and the deflection element 34*a*.

The first relay optical system 33 includes a BD sensor 40 as an example of a position detector. The BD sensor 40 can be a single channel detector or a two-dimensional image area sensor. The BD sensor is located between the scanning lens 33*a* and 33*b*. Specifically, the BD sensor 40 is located at a position at which it does not interfere with the image forming laser light in the first relay optical system 33. For example, on the entire scanning area of the laser light by the scanning section, the BD sensor 40 is located at a predetermined position in a non-image area. The non-image area is outside an image area in which a displayed image is formed. The BD sensor 40 is configured to detect the laser light. The BD sensor outputs a current in accordance with intensity and timing of the received light as a BD signal 41. The BD signal 41 is input to the position determination circuit 8*a* within the driving signal supply circuit 8. Based on the BD signal 41, scanning timing of the laser light is determined. In other word, the position determination circuit 8*a* receives the BD signal 41 as an input from the BD sensor 40. Then, the position determination circuit 8*a* determines whether the scanning position is within the image area based on the BD signal 41. Then, using the BD sensor 40, emission timing of the laser light is adjusted.

The second relay optical system 35 includes two serially arranged lens systems 38 and 39 of positive refractivity. The laser light scanned by the vertical scanning section 34 is converted, by the lens system 38, so that the centerlines of beams of the scanned laser light become parallel to one another and form convergent laser beams. The laser light converted by the lens system 38 is converted by the lens system 39 so as to converge to a viewer's pupil 10*a* via a half mirror 15 included in the RSD 1.

After passing through the second relay optical system 35, the laser light, which is the imagewise light Lx, is reflected by a half mirror 15 and is made to enter the viewer's pupil 10*a*. When the imagewise light Lx enters the pupil 10*a*, a display image in accordance with the image signal 5S is projected on the retina 10*b*. In this manner, the viewer recognizes the imagewise light Lx as a displayed image.

In the present embodiment, a configuration including the lens systems 38 and 39 and a half mirror 15 which constitute the second relay optical system 35 functions as an ocular optical system section; the ocular optical system section lets the laser light two-dimensionally scanned by the scanning section enter the pupil 10*a* of at least one of the viewer's eyes 10. The laser light entered the pupil 10*a* forms an image on the retina 10*b* through a crystalline lens of the eye to thereby display an image.

The half mirror 15 lets outside light Ly pass therethrough and enter the viewer's eyes 10. With this, the viewer recognizes the image in accordance with the imagewise light Lx as overlapping with a background recognized in accordance with the outside light Ly. As described above, the RSD 1 of the present embodiment is a see-through display which lets the imagewise light Lx emitted from the projection unit 3 be projected on viewer's eyes 10 and, at the same time, lets the outside light Ly pass therethrough. The RSD 1 may alternatively be an immersive display which lets only the imagewise light be projected on the user's eye without letting the outside light pass therethrough.

The thus-configured RSD 1 forms a head mounted display which is mounted on a viewer's head if the RSD 1 includes a support member which supports the configuration including the projection unit 3. The support member is, for example, an eyeglass frame and a goggle band. Note that the configuration including the projection unit 3 may be mounted on, for example, glasses and a helmet which a user already wears as a support member. Hereinafter, details of the RSD 1 of the present embodiment will be described.

Operation of Scanning Section

Operation or the like of the scanning section included in the RSD 1 will be described with reference to FIGS. 3A to 3C. In the RSD 1, there exist a image area and an non-image area as scanning areas scanned by the scanning section. In the image area, image display in accordance with the image signal 5S (hereinafter "image display") is performed along the horizontal and vertical directions. The non-image areas in which no image display is performed are located on both scanning direction sides of the image area.

Figure 3A:
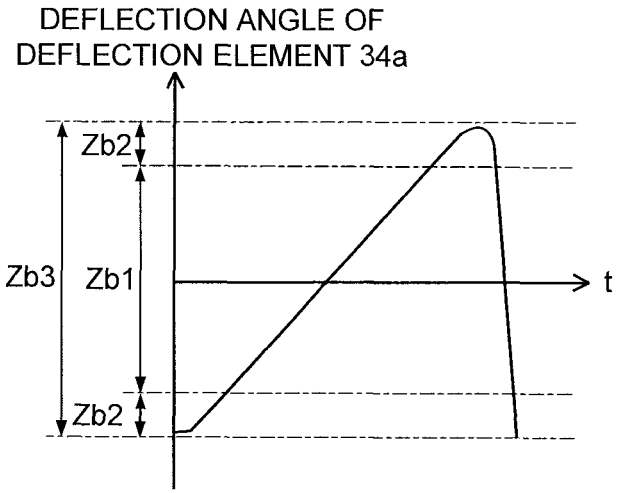
FIG. 3A illustrates a deflection angle of a deflection element 34*a* (i.e., scanning position in a vertical direction).
Figure 3B:
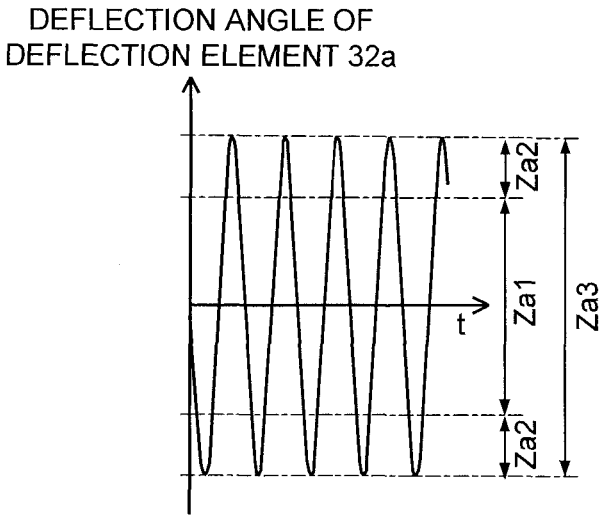
FIG. 3B illustrates a deflection angle of a deflection element 32*a* (i.e., scanning position in a horizontal direction).
Figure 3C:
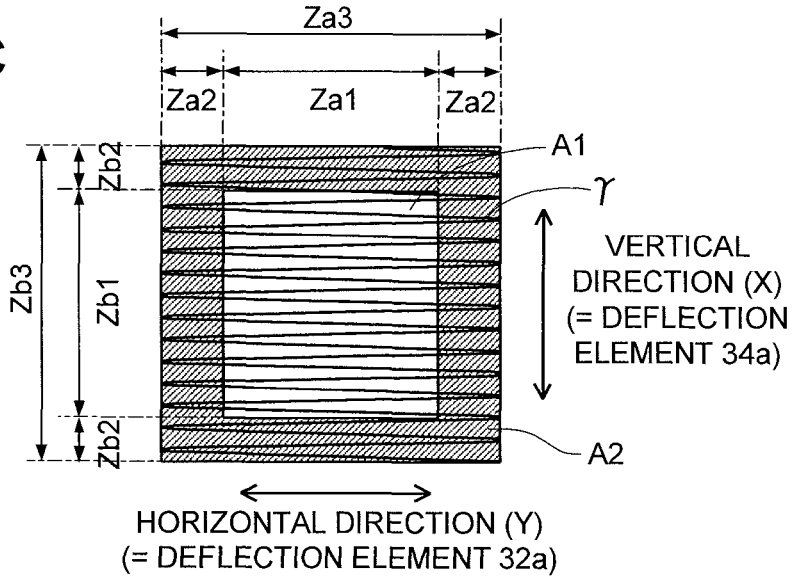
FIG. 3C illustrates an image area and a non-image area in the horizontal direction and the vertical direction.

That is, as illustrated in FIGS. 3A and 3C, a image area Za1 and non-image areas Za2 located at both sides of the image area Za1 exist along the horizontal direction which is the scanning direction of the horizontal scanning section 32. Similarly, as shown in FIGS. 3B and 3C, a image area Zb1 and non-image areas Zb2 located at both sides of the image area Zb1 exist along the vertical direction which is the scanning direction of the vertical scanning section 34. The image areas Za1 and Zb1 and the non-image areas Za2 and Zb2 are switched depending on a value of the modulated current supplied to the light source section 7.

The image areas Za1 and Zb1 are, in particular, the area in which laser light of which intensity is modulated in accordance with the image signal 5S is actually emitted from the light source section 7 (hereinafter, "laser light for image formation") among the maximum areas Za3 and Zb3 which can be scanned with laser light by the deflection elements 32*a* and 34*a* of the horizontal scanning section 32 and the vertical scanning section 34, respectively (hereinafter, "maximum scanning area"). That is, the laser light for image formation is emitted at the timing at which the scanning positions of the deflection elements 32*a* and 34*a* of the scanning section are in the image areas Za1 and Zb1 which are defined as predetermined areas. The non-image areas Za2 and Zb2 in which no laser light for image formation is emitted among the maximum scanning areas Za3 and Zb3, are located on both sides of the image areas Za1 and Zb1 in the scanning direction of the laser light.

An image area A1 corresponding to the image areas Za1 and Zb1 and the non-image area A2 (see shadow area) corresponding to the non-image areas Za2 and Zb2 are formed on the screen on which an image is formed by the laser light which is two-dimensionally scanned by the scanning section, as illustrated in FIG. 3C.

That is, the image area A1 is the display area of the image on the screen. In a case in which the scanning position of the laser light (hereinafter, "light scanning position") is in the image area A1, the modulated current of the size in accordance with the image signal 5S is supplied to the light source section 7. Then the laser light for one frame is scanned by the horizontal scanning section 32 and by the vertical scanning section 34. This scanning is repeated for the image in each frame. In the present embodiment, as illustrated in FIG. 2, the non-image area A2 is formed as a frame-shaped area which surrounds the rectangular-shaped image area A1.

Loci gamma of the laser light scanned by the horizontal scanning section 32 and by the vertical scanning section 34, assuming that the laser light is constantly emitted from the light source section 7, are illustrated in FIG. 3C. Note that the reduced number of loci gamma are illustrated in FIG. 3C for the ease of illustration because the number of scanning events in the horizontal scanning direction (Y direction) by the horizontal scanning section 32 is about several hundreds or about one thousand for each frame.

Characteristics of Light Source Section

Here, characteristics of the semiconductor lasers of each color 11*a*, 12*a* and 13*a* included in the light source section 7 will be described. FIGS. 4 to 7 illustrate current-light output characteristics ("IL characteristics") which represent a relationship between a value of the current supplied to the laser of each color and the light output of the semiconductor laser. In the IL characteristics, a curve representing a correlation of the current and the light output is called an IL curve. In the IL curve illustrated in FIGS. 4 to 7, the horizontal axis represents the value of the current (I) supplied to the semiconductor laser and the vertical axis represents the light output (L) of the semiconductor laser. The light output value is a PD voltage value ("PD value") which is a output value of a photo diode ("PD") 11*d*, 12*d*, and 13*d* included in the semiconductor laser (FIG. 2).

Figure 4:
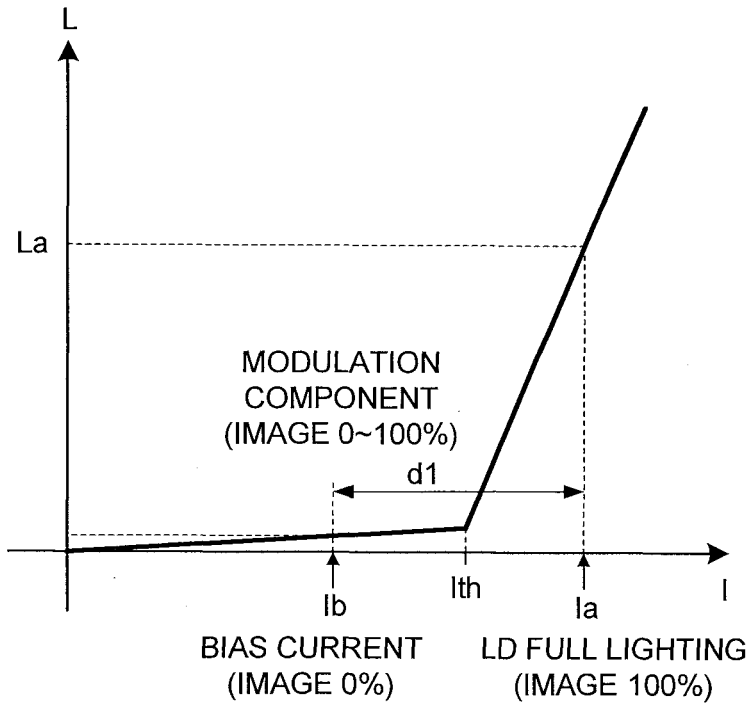
FIG. 4 illustrates an IL curve representing current-light output characteristics.

As illustrated in FIG. 4, the light output increases with the increase in the current value until the value of the current supplied to the semiconductor lasers of each color 11*a*, 12*a* and 13*a* reaches an inherent threshold current value Ith. When I<Ith, an increase in the light output is small and the light output is significantly small. When the value of the current supplied to the semiconductor lasers of each color 11*a*, 12*a* and 13*a* exceeds the threshold current value Ith, the light output rises rapidly.

The semiconductor lasers of each color 11*a*, 12*a* and 13*a* each includes a capacity like a capacitor. Since a part of the current is used to charge the capacity in the process that the value of the current supplied increases from 0 to the threshold current value Ith, rising of the current which contributes actual emission is delayed accordingly. Thus the semiconductor lasers of each color 11*a*, 12*a* and 13*a* each requires a delay time before emitting light since each laser begins receiving supply of current.

With such characteristics of the laser, a bias current of value Ib is supplied to each laser from the viewpoint of increase in response of the light source section 7 in the RSD 1 of the present embodiment. With the bias current (value Ib) being supplied, the laser is in the standby state and thereby the delay of emission is reduced. That is, the response of the light source section 7 is increased. In the RSD 1 of the present embodiment, the bias current value Ib is smaller than about half the value Ia of the current with which each laser is in a full lighting (with the light output La) (hereinafter, "maximum current"). In some cases, a value slightly smaller than the threshold current value Ith, for example, may be used as the bias current value.

The value of the current supplied to the semiconductor lasers 11*a*, 12*a* and 13*a* of each color falls within a range d1 from the bias current value Ib to the maximum current value Ia. That is, the state of the bias current value Ib corresponds to the state in which image is 0% and the state of the maximum current value Ia corresponds to the state in which image is 100%. That is, the current range d1 in which the image is 0 to 100% corresponds to the brightness range of the laser light as the modulation component in accordance with the image signal 5S. Accordingly, as illustrated in FIG. 4, the brightness level of the displayed image in a state in which the image is 0% with bias currents of value Ib being supplied to the semiconductor lasers of each color 11*a*, 12*a* and 13*a* corresponds to the black level. The current value range d1 from the bias current value Ib to the maximum current value Ia corresponds to the modulation width of the modulated current supplied to the semiconductor lasers of each color 11*a*, 12*a* and 13*a*. Thus, the modulated current supplied to semiconductor lasers of each color 11*a*, 12*a* and 13*a* changes within the range to the maximum current (image: 100%) in accordance with the image signal 5S with reference to the bias current which specifies the black level (image: 0%).

Control Operation by Light Source Control Section

In the RSD 1 of the present embodiment, APC to control the maximum current value Ia to a predetermined value ("white level APC") and APC to control the bias current value Ib to a predetermined value are performed as the APC in which optical output is controlled automatically regarding the light output of the semiconductor lasers of each color 11*a*, 12*a* and 13*a*. In the white level APC, the optical output is automatically controlled such that the light output (i.e., the maximum amount of light ("white level")) of the semiconductor lasers of each color 11*a*, 12*a* and 13*a* in a state in which the image is 100% becomes a predetermined value. In the black level APC, the optical output is automatically controlled such that the light output (i.e., the minimum amount of light ("black level")) of the semiconductor lasers of each color 11*a*, 12*a* and 13*a* in a state in which the image is 0% becomes a predetermined value. Thus, in a case in which the white level APC and the black level APC are performed, the following phenomena may occur since the semiconductor lasers of each color 11*a*, 12*a* and 13*a* have the IL characteristics described above.

Figure 12:
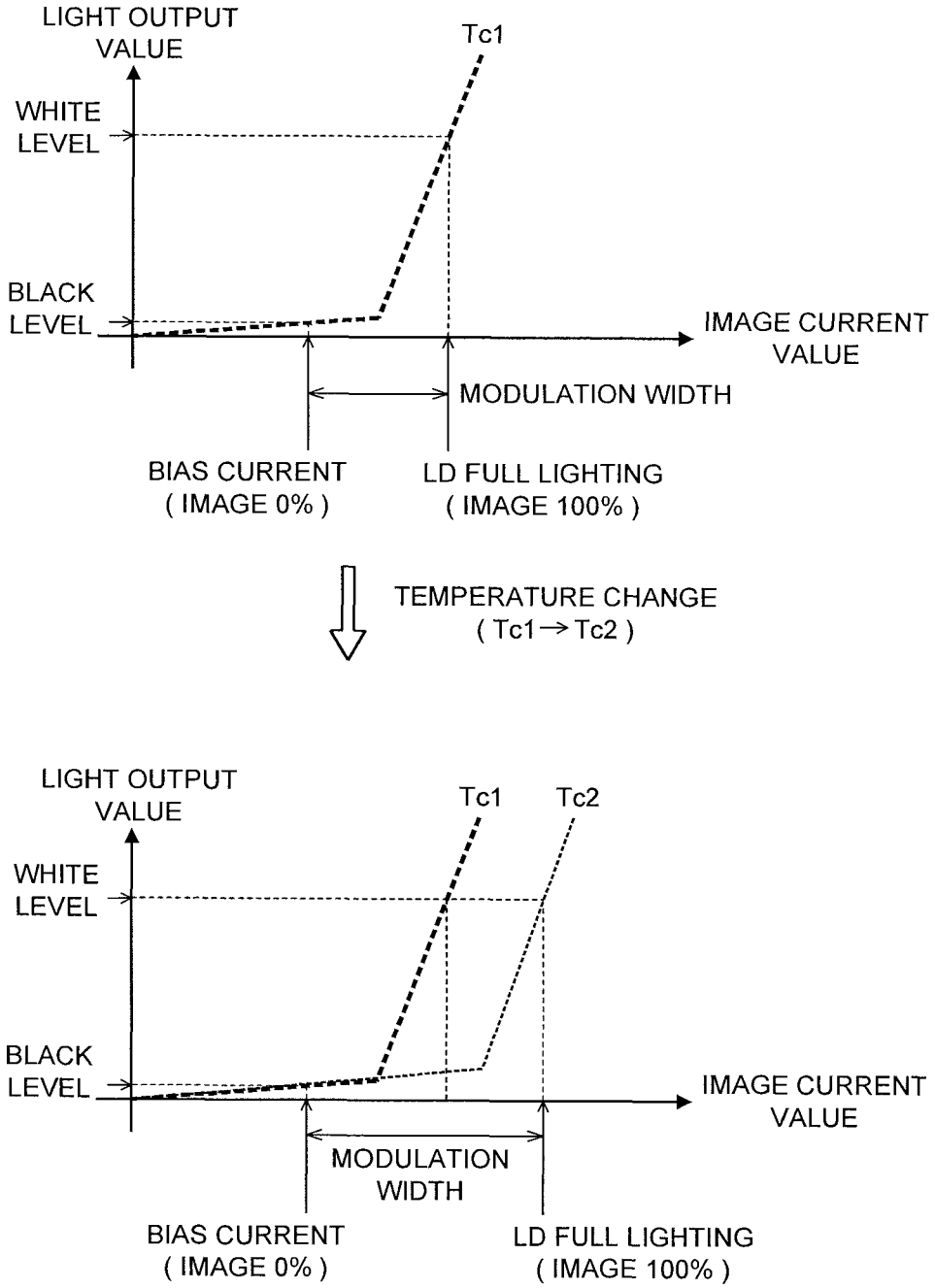
FIG. 12 illustrates APC control.

The IL characteristics of the semiconductor lasers of each color 11*a*, 12*a* and 13*a* change with, for example, heat generated during emission of laser light or changes in the ambient temperature. For example, as illustrated in FIG. 12, the IL characteristics change from curve (Tc1) illustrated with dashed line to curve (Tc2) illustrated by dotted line because laser temperature increases from temperature Tc1 to temperature Tc2. These changes cause the modulation width and the threshold current value (see the value Ith of FIG. 4) to increase when the APC is performed to keep the black level. When the modulation width of the modulated current as the current for image display changes, it is possible that a relationship between the gamma table 53 and the input image data is no longer accurate. Then, the reference current value 51 and the reference light output value 52 are stored in the storage section 50 included in the controller 5 (FIGS. 1 and 2). The reference current value 51 is a value set to an increase side of each of the threshold current values in the IL curves of the semiconductor lasers of each color 11*a*, 12*a* and 13*a* which are the light sources. The reference light output value 52 is a value of the light output which corresponds to the reference current value 51.

Figure 5:
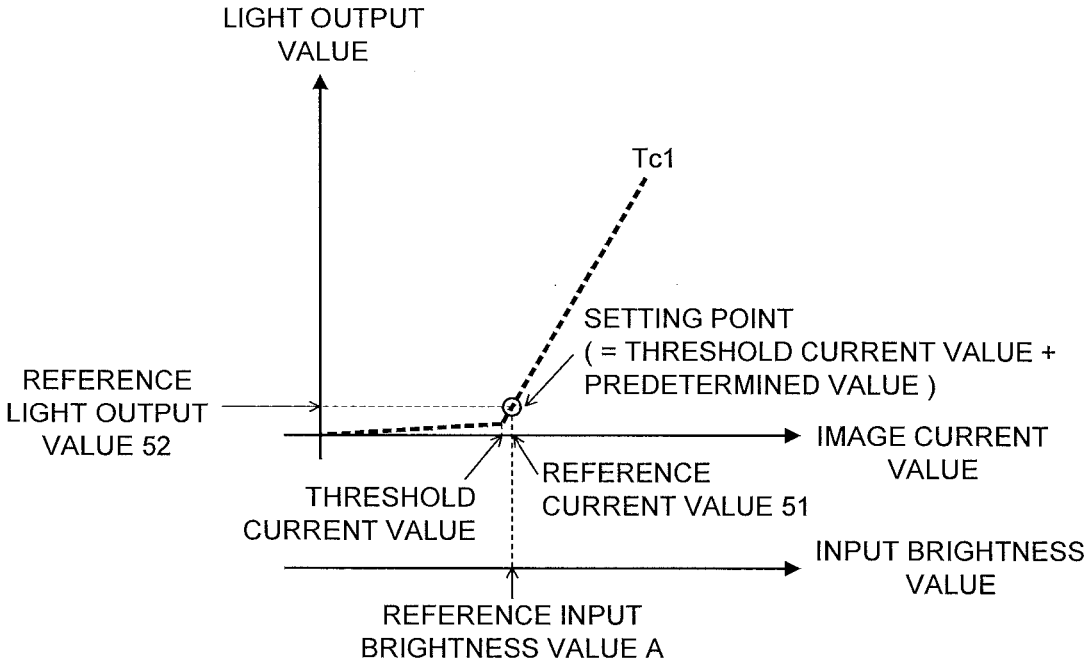
FIG. 5 illustrates a relationship between an input brightness value and an image current value in the IL curve (i.e., initial gamma table).

When the RSD 1 is assembled in the factory, various values are preset in the storage section 50. For example, the reference current value 51, the reference light output value 52, reference input brightness value A, and the gamma change threshold 54 are stored in the storage section 50 at the time of the assembling. A setting point is first determined based on a value greater than the threshold current value by a predetermined value in the IL curves of the semiconductor lasers of each color 11*a*, 12*a* and 13*a* (FIG. 5). Here, the reference input brightness value A corresponds to the current value at the setting point. The image current value "a", which corresponds to the reference input brightness value A, is an initial value of the reference current value 51 that is included in the initial gamma table 53A (FIG. 9A). The reference light output value 52, which is the reference value of output PD voltage value, corresponds to the reference current value 51. The controller 5 creates the initial gamma table 53A in accordance with those value stored in the storage section 50. The created initial gamma table 53A is stored in the gamma table 53 of the storage section 50.

When the RSD 1 is powered on, the controller 5 receives the laser light output detected by the PDs 11*d*, 12*d*, and 13*d* at the reference current value 51 in the non-image scanning area Za2 and Zb2 illustrated in FIG. 3C (i.e., an non-image area A2). If the detected light output deviates from the reference light output value 52 by a predetermined value or greater, the controller 5 sweep an image current value to obtain the image current value corresponding to the reference light output value 52 and lets the initial gamma table 53A change in accordance with the sweeping result. Changed initial gamma table 53A is stored in the gamma table 53 as the changed gamma table 53B (FIG. 9B). If the changed gamma table 53B already exists at the sweeping, the changed gamma table 53B is changed in accordance with the sweeping result, and the changed gamma table 53B is overwritten.

Here, the digital-analog converter for the LD converts digital signals as control signals into analog signals. The control signals which correspond to the modulated current and to the bias current are converted as image current value for each of the semiconductor lasers of each color 11*a*, 12*a* and 13*a*.

Figure 6:
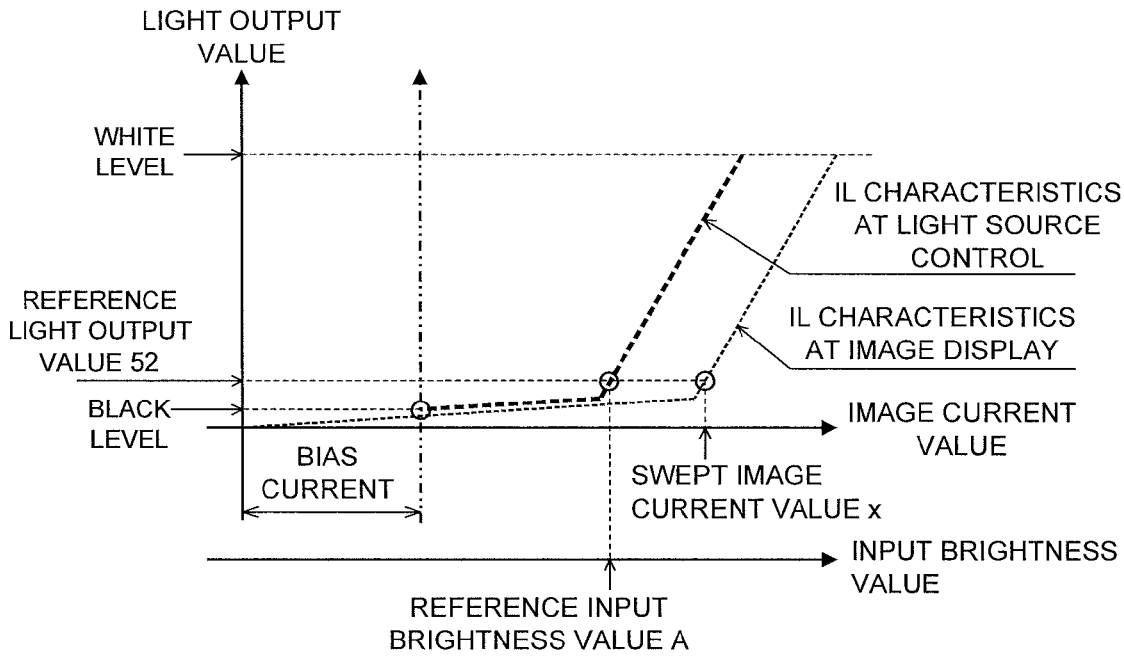
FIG. 6 illustrates the relationship between an input brightness value and an image current value when the IL curve changes.

There are two cases in which the output PD voltage value deviates from the reference light output value. One case is due to APC. Upon power-on of the power supply by a viewer (user), the driving signal supply circuit 8 performs APC. For example, if the actually used IL characteristics (i.e., the curve represented by a dotted line) and the IL characteristics set at the factory (i.e., the curve represented by a dashed line) deviate from each other as illustrated in FIG. 6, the image current value near the threshold corresponding to the reference light output value is also made to deviate when the black level APC and the white level APC are performed. The other case is due to a change of the IL characteristics itself.

After the black level APC and the white level APC are completed, the controller receives, in the non-image areas Za2 and Zb2 (see FIG. 3C), the light output of the laser (i.e., the A/D converted PD voltage value) detected by the PDs 11*d*, 12*d* and 13*d*, where the semiconductor lasers 11*a*, 12*a*, and 13*a* emit laser light at the image current value "a" stored as the reference current value 51. The controller 5 compares the PD voltage value of the detected light output with the reference light output value 52. If the comparison result deviates from the predetermined value, the controller 5 receives, through the sweeping, the PD voltage value by letting the image current value change with the stored reference light output value 52 being the predetermined value (see FIG. 6).

If the PD voltage value of the detected light output is smaller than the reference light output value 52 at the time of sweeping for the image current value with which the reference light output value 52 is obtained, the controller 5 lets the image current value increase. If the detected light output is larger than the reference light output value 52, the controller 5 lets the image current value decrease.

Figure 7:
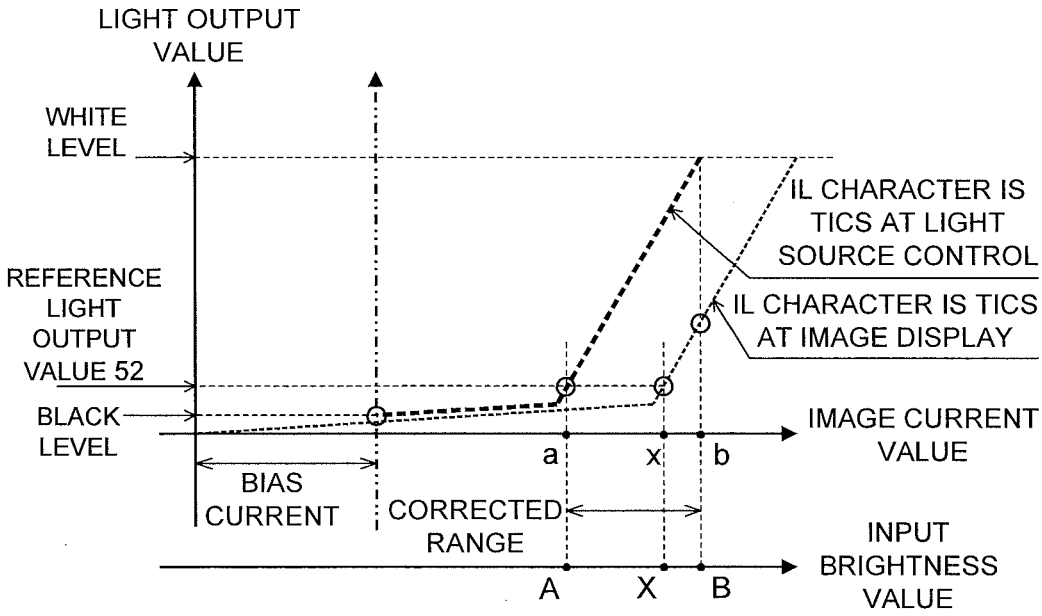
FIG. 7 illustrates the procedure when the gamma table is changed with the IL curves.

The controller 5 then compares the swept image current value x and the image current value "a" (see the initial gamma table 53A in FIG. 9) in the gamma table 53 corresponding to the reference input brightness value A (see FIG. 7). Also in FIG. 7, the dotted line curve represents the actually used IL characteristics and the dashed line curve represents the IL characteristics upon adjustment of the light source at the time of shipment. If the difference in the comparison result is larger than the gamma change threshold 54, the controller 5 picks up a first input brightness value B (i.e., an image current value b) with which the image current value becomes x or greater from the initial gamma table 53A (FIG. 9A).

The controller 5 then calculates a gamma change coefficient to obtain a slope α by following Formula 1 in accordance with the swept for and detected image current value b and the image current value "a" corresponding to the reference input brightness value A. With this, the controller 5 performs linear interpolation to the input brightness values A to B in FIG. 9A.

$$\alpha=(b-x)/(B-A) \quad (1)$$

The gamma table 53 is changed in the following correction in a case in which the input brightness value is in a section of A to B in the image area A1 (FIG. 3C) which is a display area of image using the slope α obtained by Formula 1 (see the gamma table 53 after the change illustrated in FIG. 9A). The image current value x is correlated to the input brightness value A in the gamma table 53 after the change is made such that the input brightness value A is smaller than the input brightness value B and the image current value x is smaller than the image current value b in the section to be corrected (A to B). Similarly, the image current value x+α is correlated to the input brightness value A+1, the image current value x+2α is correlated to the input brightness value A+2, the image current value x+3α is correlated to the input brightness value A+3, . . . , the image current value x+ (n−1)α, is correlated to the input brightness value X, and the image current value x+nα, which is equal to b, is correlated to the input brightness value B. That is, the gamma table 53 is changed through the linear interpolation with reference to the correction coefficient α swept and obtained image current value b.

The flow of the gamma table 53 change process which the controller 5 performs will be described with reference to FIG. 8. Processes after the powering on of the RSD 1 will be described. The process of FIG. 8 is performed by the controller 5.

When the RSD 1 is powered on and the scanning section is driven, the scanning lines are counted (step S11). Counting scanning lines is performed by counting a number of BD signals 41. This will be explained using FIGS. 10A to 10D later.[0066] Subsequently, it is determined whether the laser light being scanned (i.e., the scanning line) is in the image area A1 (see FIG. 3C) (step S12).

If the laser light is not in the image area A1, i.e., if the laser light is in the non-image area A2 (step S12: No), it is determined whether the scanning line is a gamma change control start lines (step S13). The gamma change control start lines are the scanning line in which the gamma change control is performed. In this embodiment, the gamma change control start lines are included in the non-image area A2. That is, the bias current control, the modulated current control, and the gamma change control are performed for each scanning line in the non-image area A2 in the RSD 1. That is, timing at which the gamma change control operation is performed is specified depending on each scanning line.

If the scanning line is not the gamma change control start line (step S13: No), another control is performed (step S14). The process then proceeds to step S30. Another control in step S14 includes control of doing nothing.

If it is determined in the process of step S13 that the scanning line is the gamma change control start line (step S13: Yes), the laser light output detected by the PDs 11*d*, 12*d*, and 13*d* (i.e., the A/D converted PD voltage value) is detected with the image current value "a" stored as the reference current value 51 (Step S13-1).

In Step 13-A, the PD voltage value of the light output detected in step S13-1 is compared to the reference light output value 52. In Step S13-2, it is determined whether the comparison result deviates from the predetermined range (i.e., the reference light output value 52 with the tolerance). If the comparison result deviates by a predetermined range or greater (step S13-2: Yes), step S15 is performed. If the comparison result does not deviate by a predetermined value or greater (step S13-2: No), step S14 is performed.

In Step S15, the image current value x is obtained. This will be explained later with reference to the FIG. 11. The image current value x is within a value of "the reference light output value 52± the target range". Subsequently, the swept and obtained image current value x and the corresponding image current value "a" corresponding to the reference input brightness value A in the gamma table 53 are compared to each other (step S16).

In step S17, it is determined whether the comparison result is equal to or greater than the gamma change threshold 54. If the comparison result is less than the gamma change threshold 54 (step S17: No), the process proceeds to step S30. If the comparison result is equal to or greater than the gamma change threshold 54 (step S17: Yes), the gamma change flag is set (step S18). In step S19, the gamma change coefficient is calculated with Formula 1 and the gamma table 53 is changed through linear interpolation as described above.

In step S30, one-line scanning in which the gamma change process or other control processes are performed is completed, the process proceeds to step S11.

The number of the scanning lines is counted in step S11. In step S12, it is determined whether the scanning line is located in the image area A1. If the laser light is in the image area A1 (step S12: Yes), it is determined whether the gamma change flag is set (step S20).

If the gamma change flag is set (step S20: Yes), the gamma table is changed in accordance with gamma change coefficient obtained in step S19 (step S21). In the present embodiment, the changed gamma table 53B separated from the initial gamma table 53A is generated in the step S21 (FIG. 9B). The changed gamma table 53B is stored in the storage section 50 as a part of the gamma table 53, while the initial gamma table 53A remains in the gamma table 53. If there a previous changed gamma table 53B already exists, the previous changed gamma table 53 is overwritten.

When the changed gamma table 53B is generated in step S21, the gamma change flag is reset (step S22). Then the process proceeds to step S23.

After the step S22, or if the gamma change flag is not set (step S20: No), the image is displayed using the gamma table 53 (step S23). That is, a current is supplied to the semiconductor lasers 11*a*, 12*a*, and 13*a* based on the gamma table 53. If the gamma table 53 includes the changed gamma 53B, the changed gamma 53B is used for displaying the image. On the other hand, if the gamma table 53 does not include the changed gamma 53B, the initial gamma table 53A is used for displaying the image. After the image display in step S23, i.e., scanning of one line is completed (step S30), the process proceeds to step S11.

Determination of Scanning Position

Figure 10A:
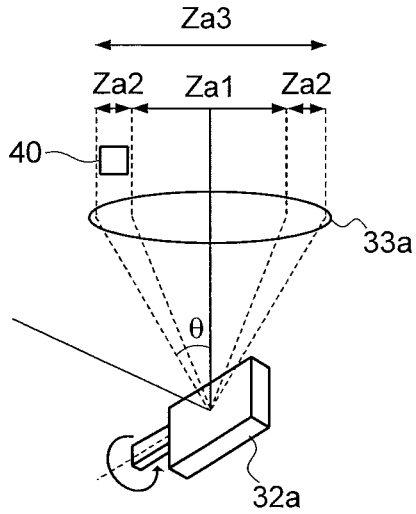
FIG. 10A illustrates a position of a BD sensor relative to a scanning lens and a horizontal scanning section.

As illustrated in FIG. 10A, BD sensor 40 is disposed behind the scanning lens 33*a*. Specifically, the BD sensor 40 is disposed in one side of the non-image areas Za2 in the main-scanning direction.

Figure 10B:
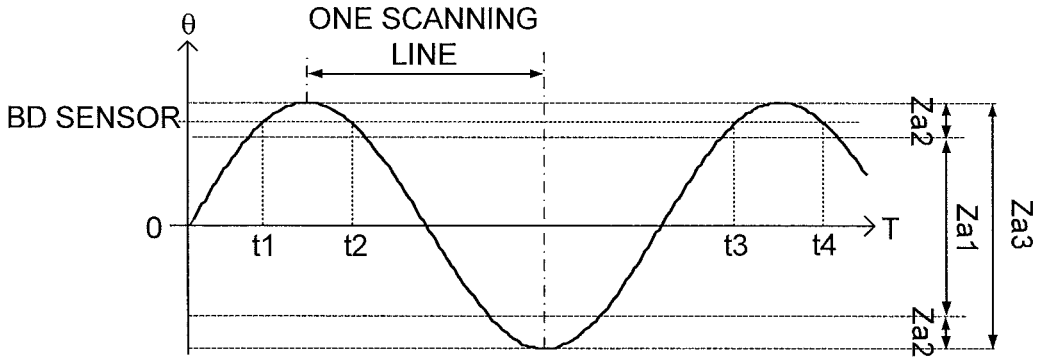
FIG. 10B illustrates a time variation in a scanning position of the horizontal scanning section.

The position of the BD sensor 40 in the maximum scanning area Za3 and the resonant frequency of the deflection element 32*a* is predetermined by a design of the RSD 1; they are stored in the storage section 50 in the factory. Thus, as shown in FIG. 10B, position of the BD sensor 40 in the maximum in one scanning line is predetermined.

Figure 10C:
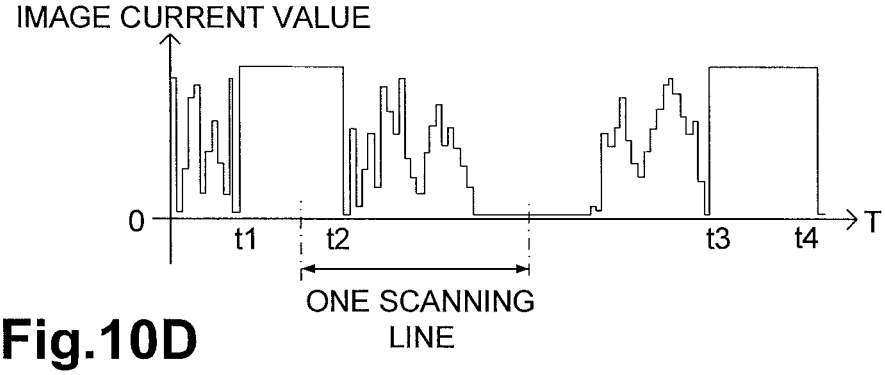
FIG. 10C illustrates a time variation in an input current value supplied to a semiconductor laser.

When the scanning position is in the non-image area Za2, the laser light should emit to generate the BD signal 41. The controller 5 controls the driving signal supply circuit 8 to supply a constant input current to the semiconductor lasers 11*a*, 12*a*, and 13*a*. As illustrated in FIG. 10C, the constant input current is supplied in the one side of the non-image area Za2, and the modulated current corresponding to the image signal 5S is supplied in the image area Za1.

Figure 10D:
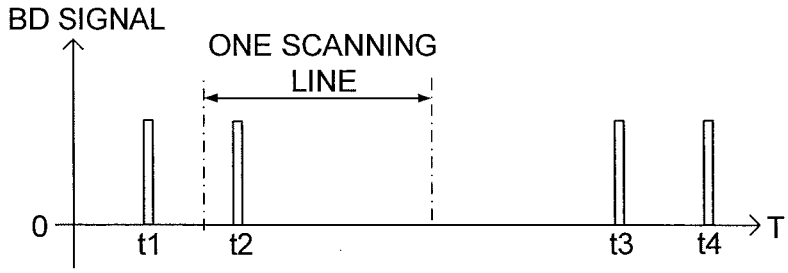
FIG. 10D illustrates a time variation in a BD signal generated by the BD sensor.

By virtue of the constant input current, as shown in FIG. 10D, BD signal 41 is generated in each scanning line in the main-scanning direction. The controller 5 counts a number of BD signals 41; this corresponds to counting the number of the scanning lines. Note that each frame of image is displayed with a predetermined number of the scanning lines. Thus, the controller 5 resets the counted number of the scanning lines when the counted number reaches the predetermined number.

Sweeping Image Current Value

Figure 11:
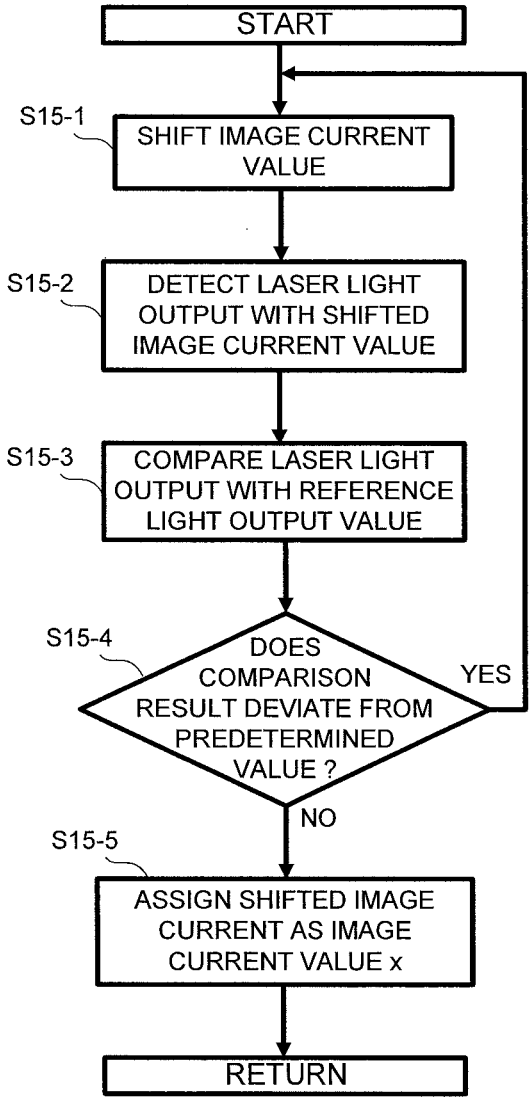
FIG. 11 illustrates a sub-flow of S15 in FIG. 8.

The process to obtain the image current value x is explained with reference to the FIG. 11. This process is performed by the controller 5. In step S15-1, the image current value is shifted. That is, if the PD voltage value detected in the step S13-1 is smaller than the reference light output value 52, the image current value increases by a predetermined value. On the other hand, the PD voltage value detected in the step S13-1 is lager than the reference light output value 52, the image current value decreases by the predetermined value. The predetermined value, for example, corresponds to a least significant bit of the digital-analog converter for the semiconductor lasers 11*a*, 12*a*, and 13*a* (i.e., a minimum unit of the image current value). But the predetermined value may be an integral multiple of the minimum unit of the image current value. The predetermined value is preset in the storage section 50.

In step S15-2, the laser light output is detected by the PDs 11*d*, 12*d*, and 13*d* with the shifted image current. That is, the PD voltage value of the shifted image current is obtained.

In step S15-3, the PD voltage value of the light output detected in Step S15-2 is compared to the reference light output value 52.

In step S15-4, it is determined whether the comparison result deviates from the predetermined value, as well as the step S13-2 in FIG. 8. If the comparison result deviates by a predetermined value or greater (step S15-4: Yes), step S15-1 is performed again. On the other hand, if the comparison result does not deviate by the predetermined value or greater (step S15-4: No), step S15-5 is performed.

In step S15-5, the shifted image current is determined as the image current value x. After the step S15-5 is performed, the process returns to the step S16 in FIG. 8.

As described above, according to the present embodiment, a displayed image with appropriate brightness and stable image quality is achieved even if the characteristics of the semiconductor lasers 11*a*, 12*a* and 13*a* change caused by, for example, changes in the ambient temperature and therefore the threshold current values of the semiconductor lasers 11*a*, 12*a* and 13*a* which are the light sources change.

Since the gamma table 53 is changed through linear interpolation in accordance with the slope α which is a correction coefficient obtained in computation with reference to the swept and obtained image current value, it is only necessary to change the gamma table 53 once and no repeated creation of the gamma table 53 is necessary each time the color balance is disturbed due to temperature change, whereby a simpler process is achieved.

In the present embodiment, the APC is performed such that brightness in the white level (image: 100%) and in the black level (image: 0%) becomes constant to determine the bias current and the modulation width of the modulated current from the black level to the white level: but it is not necessary to perform the APC at both levels.

In a case in which the gamma table 53 is changed in the embodiment described above, linear interpolation is performed in accordance with a correction coefficient obtained through calculation with reference to the swept and obtained image current value. However, as another embodiment, a plurality of gamma tables may be stored in advance in the storage device of the storage section 50 and the controller 5 may select an appropriate gamma table 53 from among the plurality of gamma table stored in the storage device in accordance with the swept and obtained image current value. In this case, it is only necessary to select a gamma table in accordance with the swept and detected value without performing any computation in each event of changing the gamma table 53; thus it is possible to reduce the load to CPU or the like and simpler configuration is achieved.

In the embodiment described above, the retinal scanning image display device is described as the scanning image display. However, the present invention is applicable to other scanning image displays which scan the laser light and display an image, such as an image projection device (i.e., a laser display) in which the scanned laser light is projected on a screen surface to display an image.

What is claimed is:

1. A scanning image display device, comprising:

a light source configured to emit laser light;

a light detecting section configured to detect the laser light;

a scanning section configured to scan the laser light within a scanning area;

a current controlling section configured to control laser light by supplying a current to the light source;

a storage section configured to store a reference current value, a reference light output value, and a gamma table, the reference light output value corresponding to the reference current value, and the gamma table relating input brightness values of an image to image current values and being used to adjust the current supplied to the current controlling section, where the current supplied to the current controlling section is selected from the image current values;

a reference current section configured to supply the reference current value to the current controlling section;

a sweep section configured to sweep current values supplied to the current controlling section to obtain one current value where the detected laser light corresponds to the reference light output value when a light output detected by the light detecting section deviates from the reference light output value by a predetermined value or greater; and a change section configured to change the gamma table based on the one current value obtained by the sweep section.

2. The scanning image display device according to claim 1, wherein the light detecting section is a member selected from the group consisting of a photo diode and a beam detection sensor.

3. The scanning image display device according to claim 1 wherein, the scanning section comprises a first scanning section configured to scan the laser light in a main-scanning direction and a second scanning section configured to scan the laser light in a sub-scanning direction slower than the first scanner, the sub-scanning direction is perpendicular to the main-scanning direction.

4. The scanning image display device according to claim 1 wherein, the reference current value is greater than a threshold current value of the light source.

5. The scanning image display device according to claim 1, wherein the change section further configured to:

assign the one current value obtained by the sweep section as the image current value related to a reference brightness value corresponding to the reference light output value;

calculate a correction coefficient on the basis of the one current value perform linear interpolation to the gamma table using the correction coefficient to generate an adjusted gamma table store the adjusted gamma table in the storage section.

6. The scanning image display device according to claim 5 further comprising:

an image correction section configured to adjust an image using the adjusted gamma table.

7. The scanning image display device according to claim 5, wherein the correction coefficient is calculated by a formula of $$(b-x)/(B-A), \text{ where}$$

x is the one current value obtained by the sweep section, b is a second one of the image current values larger than x in the gamma table previously stored in the storage section, A is the input brightness value corresponding to the reference current value in the gamma table previously stored in the storage section, and B is the input brightness value corresponding to the second image current value b.

8. The scanning image display device according to claim 7, wherein

B is a first input brightness value having the image current value greater than or equal to x.

9. The scanning image display device according to claim 1, wherein the storage section is further configured to store a gamma change threshold; and the change section is configured to change the gamma table when a difference between the reference current value and x is equal to or greater than the gamma change threshold, wherein x is the one current value obtained by the sweep section.

10. The scanning image display device according to claim 1 wherein, the sweep section increases the current value when the light output detected by the light detecting section is smaller than the reference light output value, and decrease the current value when the light output detected by the light detecting section is larger than the reference light output value.

11. The scanning image display device according to claim 1 further comprising:

a determination section configured to determine whether a scanning position of the laser light is within an image area in which a displayed image is formed within the scanning area, wherein the reference current section and the sweep section are configured to be activated when the scanning position is outside the image area.

12. The scanning image display device according to claim 11, wherein the determination section comprises:

a position detector configured to detect a scanning position of laser light by receiving the laser light; and a position determination section configured to receive input from the position detector and to determine whether the scanning position is within the image area by using the input.

13. A method of controlling light output in a scanning image display device comprising:

detecting a laser light emitted from a light source;

scanning the laser light;

supplying a reference current value to the light source;

sweeping current values supplied to the light source to obtain one current value where the detected laser light corresponds to a reference light output value when a light output of the laser light detected deviates from the reference light output value by a predetermined value or greater, the reference light output value corresponding to the reference current value; and changing a gamma table based on one current value obtained by the sweeping, the gamma table relating input brightness values of an image to image current values and being used to adjust the current supplied to the light source.

14. A scanning image display device, comprising:

a light source configured to emit laser light;

a light detector configured to detect the laser light;

a scanner configured to scan the laser light;

a driving signal supply circuit configured to supply drive current to the light source;

a first memory configured to store a reference current value, a reference light output value, and a gamma table, the reference light output value corresponding to the reference current value, and the gamma table relating input brightness values of an image to image current values and being used to adjust the current supplied to the driving signal supply circuit where the current supplied to the driving signal supply circuit is selected from the image current values;

a second memory configured to store computer readable programs; and a processor configured to execute the computer readable programs to provide:

a reference unit configured to supply the reference current value to the driving signal supply circuit as the drive current;

a sweep unit configured to sweep current values supplied to the driving signal supply circuit to obtain one current value where the detected laser light corresponds to the reference light output value when a light output detected by the light detector deviates from the reference light output value by a predetermined value or greater; and a change unit configured to change the gamma table based on the one current value obtained by the sweep unit.

* * * * *